US008572919B1

(12) United States Patent
Neill et al.

(10) Patent No.: US 8,572,919 B1
(45) Date of Patent: Nov. 5, 2013

(54) FLOOR MAT SYSTEM AND DIVIDER FOR USE THEREWITH

(75) Inventors: David M. Neill, Canfield, OH (US); Daniel A. Kessler, Girard, OH (US); Ronald N. Kessler, Girard, OH (US)

(73) Assignee: R&L Marketing & Sales, Inc., Youngstown, OH (US)

( * ) Notice: Subject to any disclaimer, the term of this patent is extended or adjusted under 35 U.S.C. 154(b) by 0 days.

(21) Appl. No.: 13/594,926

(22) Filed: Aug. 27, 2012

(51) Int. Cl.
*E04C 2/38* (2006.01)

(52) U.S. Cl.
USPC ..... 52/466; 52/718.01

(58) Field of Classification Search
USPC ..... 52/467, 402, 395, 396.04, 466, 464, 52/458, 718.04, 718.01, 718.06, 718.05, 52/179, 459
See application file for complete search history.

(56) References Cited

U.S. PATENT DOCUMENTS 4,736,563 A * 4/1988 Bilhorn ..... 52/460
5,657,598 A * 8/1997 Wilbs et al. ..... 52/287.1
5,939,670 A * 8/1999 Shteynberg et al. ..... 174/481
6,345,480 B1 * 2/2002 Kemper et al. ..... 52/395
6,550,205 B2 * 4/2003 Neuhofer, Jr. ..... 52/464
7,797,900 B2 * 9/2010 Sondermann ..... 52/466
8,266,865 B2 * 9/2012 Neuhofer, Jr. ..... 52/716.8
2002/0050109 A1 * 5/2002 Grosjean ..... 52/393
2002/0095895 A1 * 7/2002 Daly et al. ..... 52/464
2007/0137129 A1 * 6/2007 Sondermann ..... 52/395

* cited by examiner

*Primary Examiner* — Christine T Cajilig
(74) *Attorney, Agent, or Firm* — Sand & Sebolt

(57) ABSTRACT

A flooring system and a divider for use therewith. The divider transitions between a first and second flooring and includes a first member and a second member that are snap-fittingly engageable with each other. A protrusion from the first member is received in a recess in the second member. The protrusion has a curved terminal end which enables the first member to pivot relative to the second member. In a first position a lower surface of the first member is parallel to a lower surface of the second member. In a second position, the lower surface of the first member is angled relative to the lower surface of the second member. A second protrusion extends outwardly from the first member and into a second recess in the second member. The first member includes a flange which extends laterally outwardly beyond a side surface of the second member.

18 Claims, 9 Drawing Sheets

10

FLOOR MAT SYSTEM AND DIVIDER FOR USE THEREWITH

BACKGROUND OF THE INVENTION

1. Technical Field

This invention relates generally to flooring systems. More particularly, this invention relates to flooring systems that encompass two flooring surfaces that are butted up against each other along a joint. Specifically, this invention is directed to a flooring system and a divider used therewith to transition over the joint. The divider includes first and second members that are engaged with each other. The second member is permanently secured to a base surface beneath the two flooring surfaces. The first member is rotatable relative to the second member between a first position where it locks one of the flooring surfaces in place, and a second position where it is disengaged from that flooring surface and the flooring surface may be removed for cleaning and/or replacement.

2. Background Information

It is frequently necessary to utilize more than one type of flooring in a building. Wherever two different types of flooring are laid adjacent each other in end-to-end relationship, there may be created an aesthetically displeasing joint between the flooring types. This is especially true of situations where one of the flooring types is raised relative to the other.

It is known in the art to place a transition piece between the two surfaces. Typically the transition piece will be permanently secured to a base surface, such as a concrete pad or wooden subfloor, in a gap between the two flooring surfaces. Each side of the transition may be butted up against an end of one of the flooring surfaces. Alternatively, one side of the transition may be butted up against an end of one of the flooring surfaces, and a region of the transition will overlap the end of the other flooring surface. Previously known devices have made it extremely difficult to remove one of the flooring surfaces, for cleaning purposes, for example. Instead, it has been necessary in the past to clean the flooring surfaces in situ.

There is therefore a need in the art for an improved transition device or divider for a flooring system that will enable the user to quickly and easily remove one of the flooring surfaces for cleaning or replacement, and which will enable that flooring surface to be easily reengaged in the flooring system when the cleaning is completed.

BRIEF SUMMARY OF THE INVENTION

A flooring system and a divider for use therewith. The divider transitions between a first and a second flooring surface and includes a first member and a second member that are snap-fittingly engageable with each other. The second member is permanently secured to a base surface upon which the first and second flooring surfaces are disposed. A protrusion from the first member is received in a recess in the second member. The protrusion has a curved terminal end which enables the first member to pivot relative to the second member. In a first position a lower surface of the first member is parallel to a lower surface of the second member. In a second position, the lower surface of the first member is angled relative to the lower surface of the second member. A second protrusion preferably extends outwardly from the first member and into a second recess in the second member. The first and second protrusions and recesses ensure that the first and second members securely engage each other.

The first member includes a flange which extends laterally outwardly beyond a side surface of the second member and engages the upper surface of the adjacent one of the first and second flooring surfaces. This engagement substantially prevents the one of the first and second flooring surfaces from being lifted off the base surface. When the first member is moved to the second position, the flange no longer engages the flooring surface adjacent the one end of the divider. Consequently, that adjacent flooring surface may be removed from the base surface. When the cleaned flooring surface is placed back onto the base surface, the first member is rotated back to the first position so that the flange once again secures it against movement.

In accordance with one aspect of the invention, the flooring system comprises:

- a first flooring surface that is adapted to be positioned upon a base surface;
- a second flooring surface adapted to be positioned on the base surface in end-to-end relationship with the first flooring surface and separated therefrom by a gap; and
- a divider positionable in the gap to provide a transition from the first flooring surface to the second flooring surface; and wherein the divider comprises:
  - a first member; and
  - a second member adapted to be secured to the base surface; wherein the first member is releasably securable to the second member.

In accordance with another aspect of the invention, the flooring system comprises:

- a first flooring surface adapted to be positioned upon a base surface;
- a second flooring surface adapted to be positioned on the base surface in end-to-end relationship with the first flooring surface and separated therefrom by a gap; and
- a divider kit for transitioning the gap between the first and second flooring surfaces; and wherein the kit comprises:
  - a plurality of first members, each of the first members having a different cross-sectional shape;
  - a second member adapted to be secured to the base surface; wherein one of the plurality of first members is selected for engagement with the second member to suit the first and second flooring surfaces to be installed on the base surface; and wherein the selected one of the first members is releasably securable to the second member.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
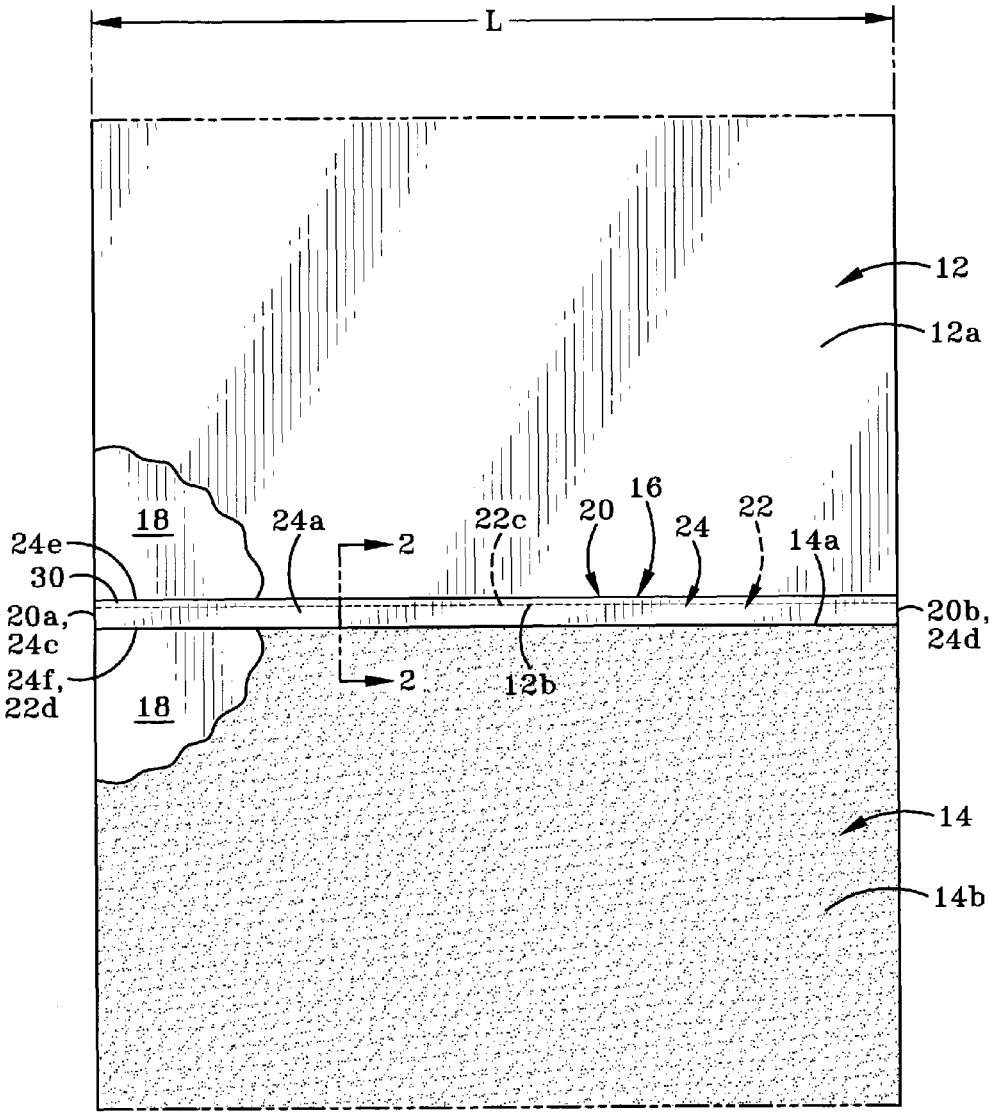
FIG. 1 is a top view of a flooring system incorporating the divider in accordance with the present invention.
Figure 2:
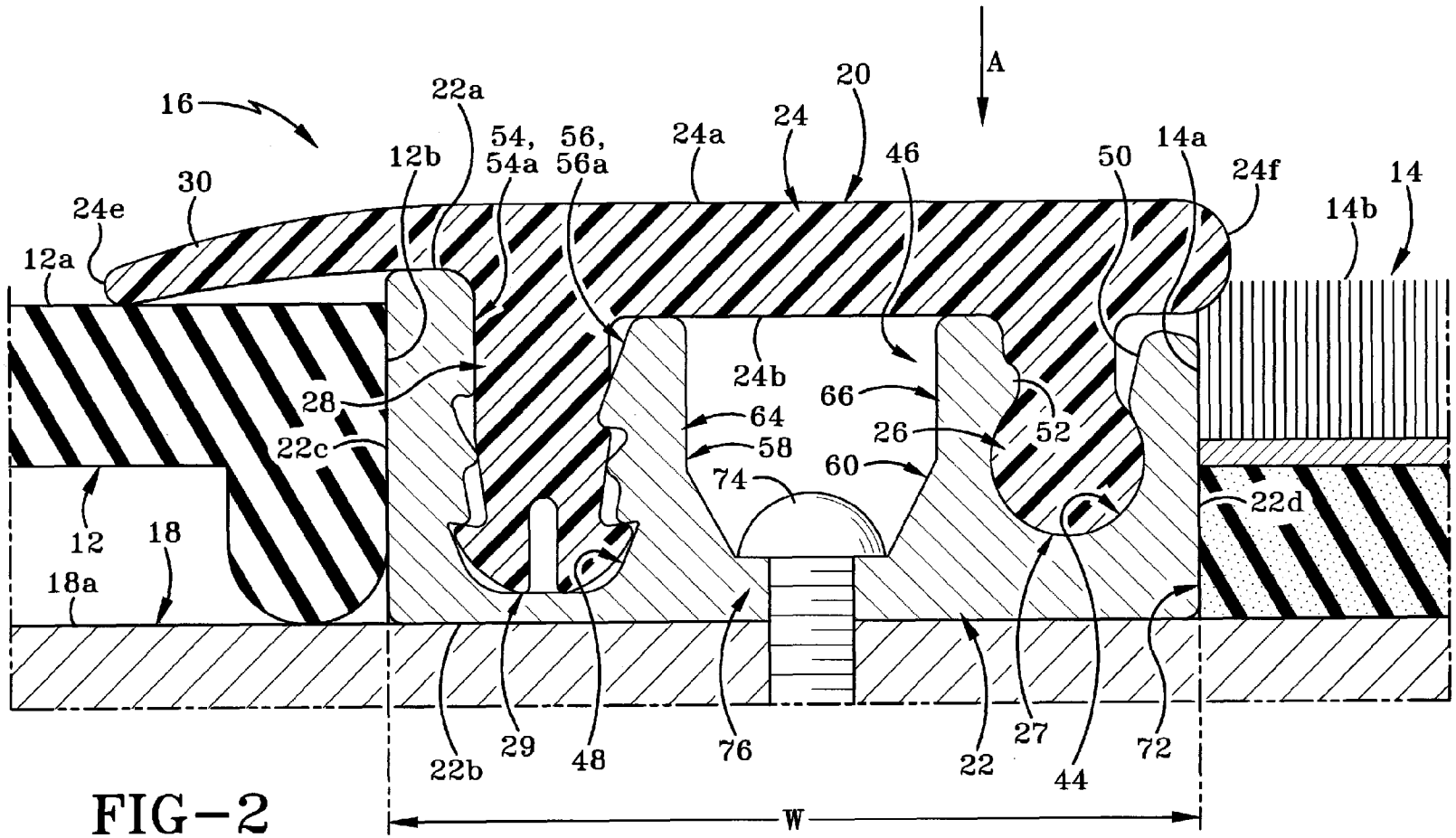
FIG. 2 is a cross-sectional side view of the floor system taken through line 2-2 of FIG. 1.

Referring to FIGS. 1 and 2 there is shown a floor system in accordance with the present invention, generally indicated at 10. Floor system 10 comprises a first flooring surface 12 and a second flooring surface 14 that are disposed in adjacent end-to-end relationship with each other, and a divider 16 that transitions a gap between the two surfaces together. Each of the first and second flooring surfaces 12, 14 is positioned on top of a base surface 18 that does not form part of the floor system 10. The base surface 18 comprises a concrete pad or wooden subfloor, for example and, preferably, divider 16 is placed directly onto upper surface 18*a* (FIG. 2) of base surface 18. It will be understood, however, that alternatively, divider 16 may be placed at least partially within a groove (not shown) formed in upper surface 18*a* of base surface 18. In the latter instance, the upper surface 22*a* of second member 22 of divider 16 may sit substantially flush with upper surface 18*a* or may extend for a distance either above or below upper surface 18*a*.

In accordance with a specific feature of the present invention, first and second flooring surfaces 12, 14 are dissimilar from each other in one or more respects. For example, as illustrated in FIG. 2, first floor surface 12 comprises a rubber mat and second floor surface 14 comprises a carpet. First and second floor surfaces 12, 14 may be made of the same materials but may of different thicknesses or heights relative to base surface 18.

In accordance with yet another specific feature of the present invention, divider 16 comprises a first member 20 and a second member 22 that are interlockingly engaged with each other. First member 20 is an elongate member having a first end 20*a* and second end 20*b*. First member 20 includes an elongate base 24, a first protrusion 26, and a second protrusion 28. Base 24 has a top surface 24*a*, a bottom surface 24*b*, a first end 24*c*, a second end 24*d*, a first side 24*e* (FIG. 2) and a second side 24*f*. First and second ends 24*c*, 24*d* form first and second ends 20*a*, 20*b* of first member 20.

Figure 4:
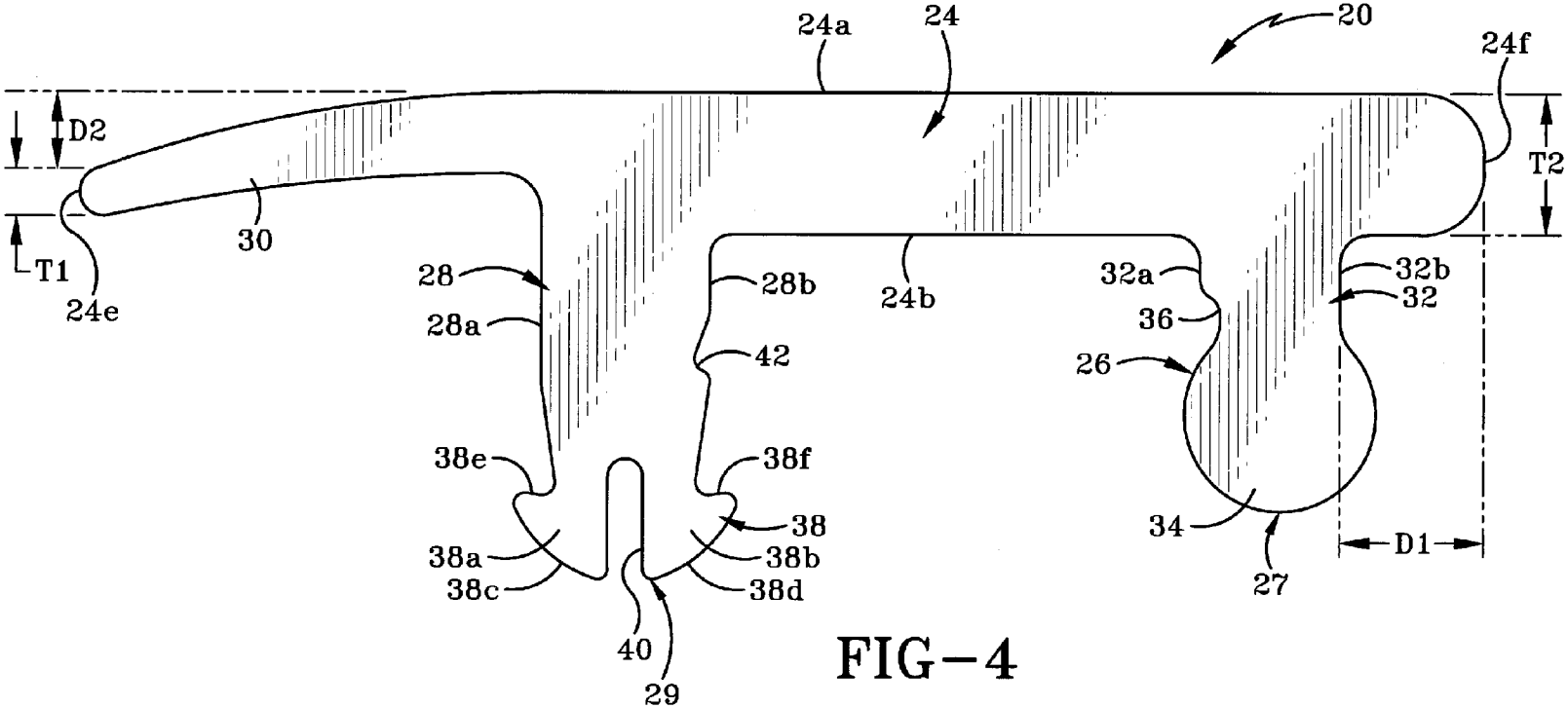
FIG. 4 is a side view of the first member of the divider.

As best seen in FIG. 4, base 24 is not the same thickness between first side 24*e* and second side 24*f*. Instead, base 24 is of a first thickness "T1" at first side 24*e* and is of a second thickness "T2" at second side 24*f*. First protrusion 26 and second protrusion 28 extend outwardly away from bottom surface 24*b* and are spaced laterally from each other along bottom surface 24*b*. First and second protrusions 26, 28 are generally parallel to each other and are disposed at right angles to bottom surface 24*b* of base 24. In accordance with a specific feature of the present invention, first and second protrusions 26, 28 preferably run the entire length "L" of base 24, from first end 24*c* to second end 24*d*. Preferably, first and second protrusions 26, 28 are substantially continuous along the length "L". It will be understood however that first and second protrusions 26, 28 could be sectioned into smaller, spaced apart first and second protrusion elements that are disposed along the length of base 24 without departing from the scope of the present invention. In that instance, each of the first and second protrusion elements would be of a substantially reduced length relative to length "L" and the elements would preferably be aligned with each other along the length "L", although staggering them across the width "W1" (FIG. 2) would also be possible.

Base 24 is of a substantially constant thickness "T2" from second side 24*f* through to the first side surface 28*a* of second protrusion 28. Beyond first side surface 28*a* the thickness of base 24 tapers gently until it is of a thickness "T1". The portion of base 24 which extends between first side surface 28*a* of second protrusion 28 and first side 24*e* forms a flange 30, the purpose of which will be described further herein. As is evident from FIG. 4, flange 30 tends to angle downwardly away from a plane aligned with top surface 24*a* of base to the degree that first side 24*e* of base 24 is disposed a distance "D2" from the plane aligned with first side 24*e*. Flange 30 is also tapered from adjacent second protrusion 28 to first side 24*e*.

Referring to FIG. 4, it may be seen that first protrusion 26 is spaced a first distance "D1" inwardly from second side 24*f* of base 24 and includes a stem 32 and a terminal end 34. Stem 32 extends outwardly from bottom wall 24*b* of base 24 and terminal end 34 is disposed remote from bottom wall 24*b*. Stem 32 has a first side surface 32*a* and a second side surface 32*b*. First side surface 32*a* defines a notch 36 in a location adjacent terminal end 34. Second side surface 32*b* of stem is substantially straight and unbroken. Terminal end 34 has a curved peripheral surface and first member 20 pivots on this curved surface when it is moved between the first and second positions, as will be hereinafter described. Preferably, terminal end 34 is generally circular in cross-sectional shape and the diameter of terminal end 34 is greater than the width of stem 32 between first and second side surfaces 32*a*, 32*b*.

Second protrusion 28 has a first side surface 28*a* and a second side surface 28*b*. Second protrusion 28 terminates in a tip 38 comprised of a first flange 38*a* and a second flange 38*b* which are mirror images of each other. First flange 38*a* extends outwardly from second protrusion 28 in a first direction and second flange 38*b* extends outwardly from second protrusion 28 in a second direction. A slot 40 is defined between first and second flanges 38*a*, 38*b* and slot 40 is oriented substantially at right angles to lower surface 24*b* of base 24. Flanges 38*a*, 38*b* each extend for a distance outwardly beyond the associated one of first and second side surfaces 28*a*, 28*b*. First flange 38*a* is provided with a first curved outer surface 38*c* and a shoulder 38*e*. Second flange 38*b* is provided with a second curved surface 38*d* and a shoulder 38*f*. Curved outer surfaces 38*c*, 38*d* aid in helping first member 20 to rotate relative to second member 22, as will be hereinafter described. Shoulders 38*e*, 38*f*, are positioned adjacent the respective one of first and second side surfaces 28*a*, 28*b* and are disposed generally at right angles thereto.

FIG. 4 shows that first side surface 28*a* of second protrusion 28 is substantially flat between its origin in lower surface 24*b* of base and where it joins shoulder 38*e*. Second side surface 28*b* includes a notch 42 defined approximately halfway between second side surface 28*b*'s origin in lower surface 24*b* of base 24 and its termination in shoulder 38*f*.

Figure 5:
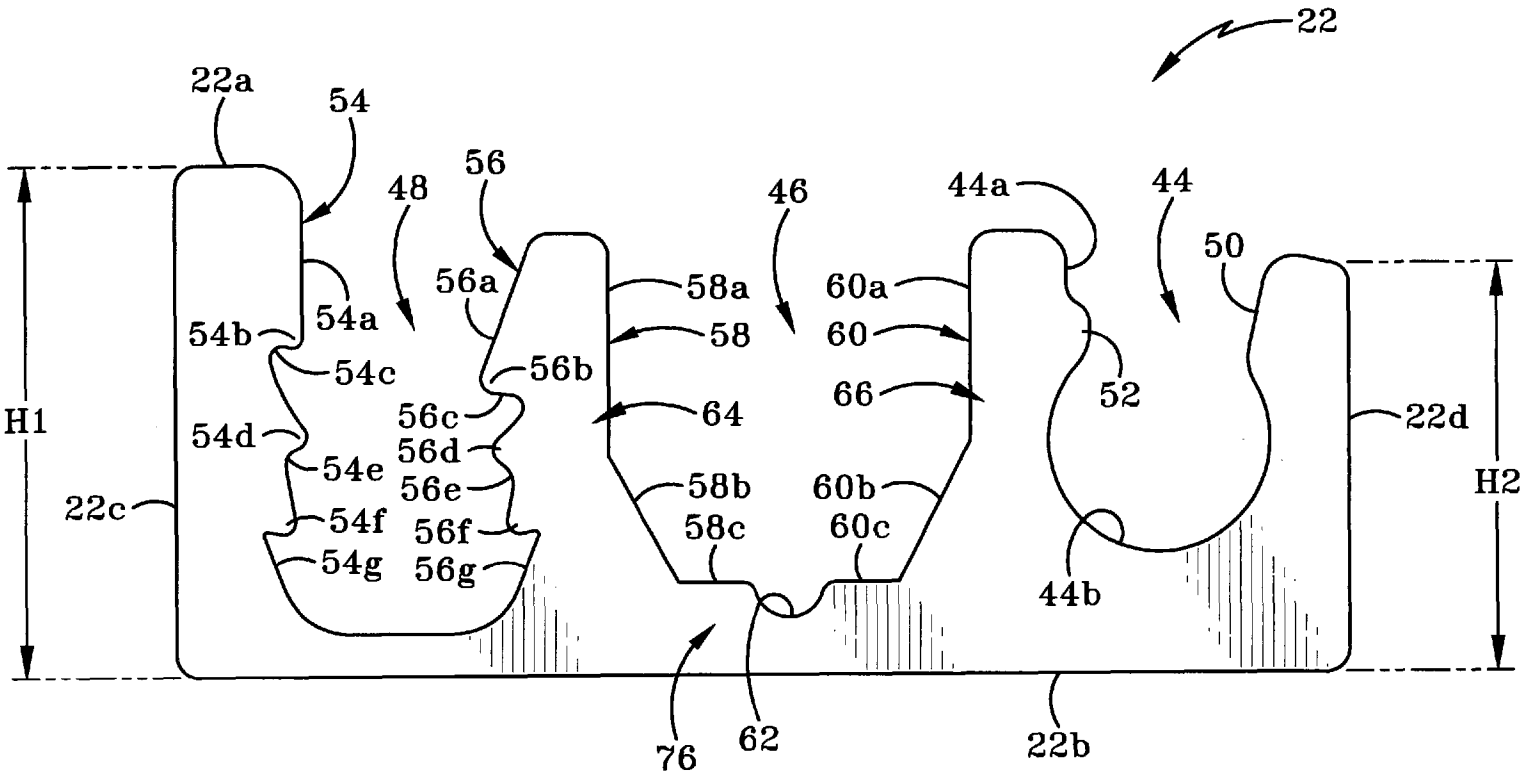
FIG. 5 is a side view of the second member of the divider.
Figure 6:
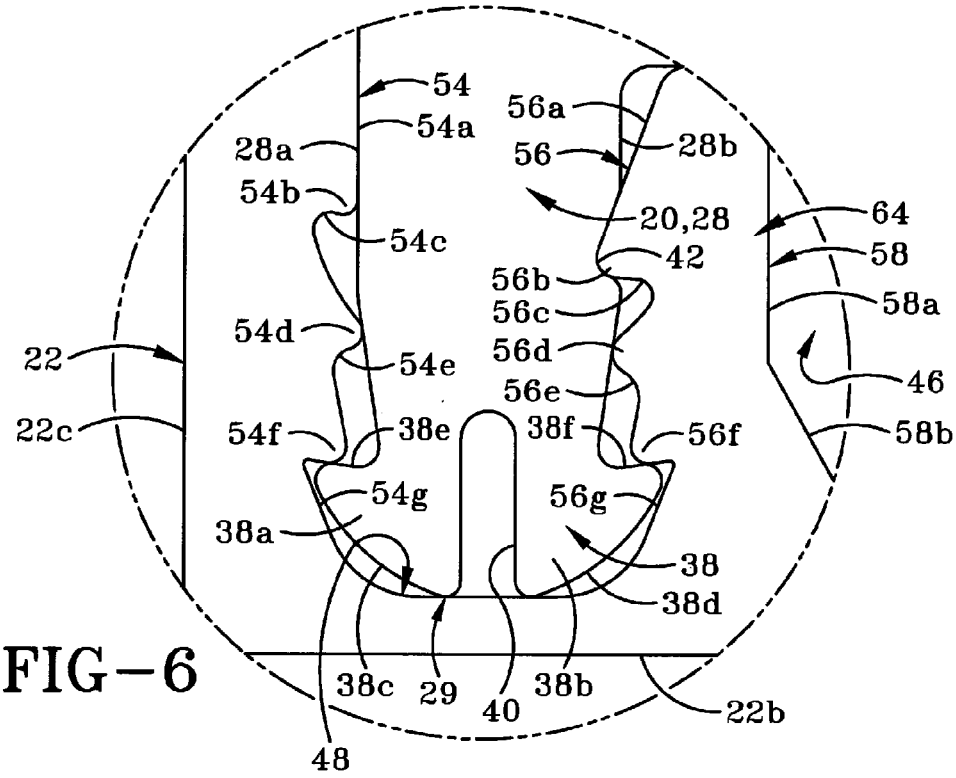
FIG. 6 is an enlarged view of the first highlighted region of FIG. 3.
Figure 7:
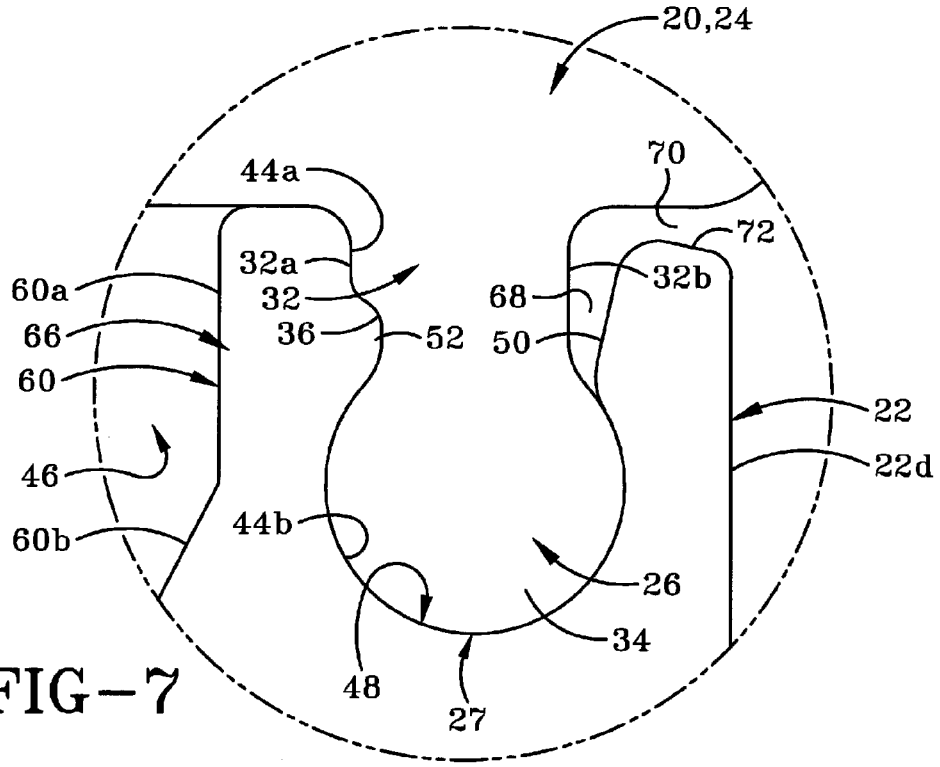
FIG. 7 is an enlarged side view of the second highlighted region of FIG. 3.

FIG. 5 shows second member 22 in greater detail. It will be understood that second member 22 preferably is configured to have a length "L" that is substantially equal to that of first member 20 and has ends (not shown) that are substantially aligned with ends 20*a*, 20*b*. Preferably, second member is substantially continuous between first and second ends 20*a*, 20*b*. It will, however, be understood that smaller individual second member sections (not shown) may be placed in spaced apart longitudinal alignment with each other to engage a substantially continuous first member 20 of length "L". The arrangement of first and second protrusions 26, 28 and recesses in second member 22 that will be described hereafter may be of a variety of configurations but the configuration in first member 20 and second member 22 is complementary.

Second member 22 comprises an upper surface 22*a*, a lower surface 22*b*, a first side 22*c* and a second side 22*d*. First side 22*c* is of a first height "H1" and second side 22*d* is of a second height "H2". As is evident from FIG. 5, second height "H2" preferably is smaller than first height "H1" and upper surface 22*a* therefore slopes downward from first side 22*c* to second side 22*d*. This difference in height aids in permitting first member 20 to pivot relative to second member 22. First and second sides 22*c*, 22*d* preferably are disposed substantially at right angles to lower surface 22*b*.

In accordance with a specific feature of the present invention second member 22 defines a first, second and third recess 44, 48, and 46 in upper surface 22*a*. First recess 44 is configured to be substantially complementary to first protrusion 26 on first member 20. First recess 44 is substantially identically shaped to first protrusion 26 and includes a stem channel 44*a* and a terminal end channel 44*b*. Stem channel 44*a* differs from stem 32 by including a face 50 that is disposed at a first angle greater than 90° relative to lower surface 22*b*. The first angle preferably is about 100° relative to lower surface 22*b*. This face 50 provides for easier insertion of first protrusion into first recess and easier removal therefrom, as will be hereinafter described. Face 50 also is angled to enable first member 20 to pivot relative to second member 22. A detent 52 extends into first recess 44 in a location that corresponds to notch 36 in first protrusion 26. Detent 52 is engaged in notch 36 to interlockingly secure first protrusion 26 in first notch 44 and thereby lock first member 20 to second member 22 and prevent their disengagement. Detent 52 is engaged in notch 36 when first member 20 is in a first position substantially parallel to lower surface 22*b* of second member 22. Detent 52 is disengaged from notch 36 when first member 20 is moved to a second position where first member 20 is pivoted so as to be disposed at an angle relative to lower surface 22*b* of second member 22. The wall defining first recess 44 includes a curved bottom surface that is complementary to terminal end 34 on first protrusion 26. This curvature enables first member 20 to pivot relative to second member 22. When first member 20 is in the second position it may be completely detached from second member 22 by pulling first member 20 outwardly away from second member 22, as will be hereinafter described. It will be understood that the detent 52 may be formed on the first protrusion 26 and the notch 36 defined in the wall which defines first recess 44 without departing from the scope of the present invention.

Second recess 48 is configured to be substantially complementary to second protrusion 28 on first member 20. Second recess 48 is defined by the surrounding wall of second member 22 to have a first face 54 that will engage first side surface 28*a* of second protrusion 28 and a second face 56 that will engage second surface 28*b* of second protrusion 28. First face 54 includes a first section 54*a*, a first detent 54*b*, a first notch 54*c*, a second detent 54*d*, a second notch 54*e*, a third detent 54*f* and a fourth notch 54*g*. First section 54*a* is disposed generally perpendicular to lower surface 22*b* and parallel to first side 22*c* of second member 22. Fourth notch 54*g* is substantially complementary shaped to first flange 38*a* of second protrusion 38*a*. The arrangement of first, second and third detents 54*b*, 54*d*, and 54*f* is such that their upper surfaces slope downwardly so as to guide second protrusion 28 deeper into second recess 48 when first and second members 20, 22 are engaged with each other. The curvature of the lower surfaces of first, second, and third detents 54*b*, 54*d*, and 54*f* is such that they tend to guide first flange 38*a* into the adjacent respective one of the first and second notches 54*c*, 54*e* when second protrusion 28 with withdrawn from second recess 48.

Second face 56 of second recess 48 is configured to include a first face 56*a*, a first detent 56*b*, a first notch 56*c*, a second detent 56*d*, a second notch 56*e*, a third detent 56*f*, and a third notch 56*g*. First face 56*a* is disposed at a second angle relative to lower surface 22*b*. The second angle is about 110° relative to lower surface 22*b*. Again, first face 56*a* is disposed at the second angle so that second protrusion 28 may slide easily into second recess 48 and may be relatively easily withdrawn therefrom. First, second, and third detents, 56*b*, 56*d*, and 56*f* have upper surfaces that slope downwardly toward lower surface 22*b* and thereby tend to guide second protrusion 28 deeper into second recess 48. First, second and third detents 56*b*, 56*d*, and 56*e* have lower surfaces that slope upwardly and thereby tend to guide the shoulder regions 38*e*, 38*f* of first and second flanges 38*a*, 38*b* into second and first notches 56*e*, 56*c* as second protrusion 28 is withdrawn from second recess 48. Third notch 56*g* is substantially complementary in shape to second flange 38*b*.

In accordance with a specific feature of the present invention, first notches 54*b*, 56*b* are offset vertically relative to each other by a small distance. Similarly, first detents 54*c*, 56*c* are offset vertically relative to each other; second notches 54*c*, 56*c* are offset vertically relative to each other; second detents 54*d*, 56*d* are offset vertically relative to each other by a smaller distance, and third detents 54*f*, 56*f* are substantially vertically and horizontally aligned with each other. This arrangement enables the pivoting motion of first member 20 to occur. Additionally, the configuration of the bottom region of second recess 48 is such that first and second flanges 38*a*, 38*b* are not tightly retained therein but, instead, first and second flanges 38*a*, 38*b* are free to move within this bottom region when first member 20 is pivoted between the first and second positions.

When second protrusion 28 is moved into or withdrawn from second recess 48 when first and second members 20, 22 are engaged or disengaged, first and second flanges 38*a*, 38*b* flex inwardly toward each other as they sequentially encounter first detents 54*b*, 56*b*; second detents 54*d*, 56*d*; and third detents 54*f*, 56*f*. This is made possible by the presence of slot 40 between first and second flanges 38*a*, 38*b*. Once flanges 38*a*, 38*b* clear the detents, they tend to spring back to their original position and become locked into the adjacent notches. So, for example, when second protrusion 28 is moved into second recess 48 and flanges 38*a*, 38*b* clear second detents 54*d*, 56*d*, the flanges will spring outwardly away from each other and become engaged in second notches 54*e*, 56*e*. When flanges 38*a*, 38*b* subsequently clear third detents 54*f*, 56*f* they will spring outwardly away from each other and become engaged in third notches 54*g*, 56*g*. When second protrusion 28 is withdrawn from second recess 48 and flanges 38*a*, 38*b* clear third detents 54*f*, 56*f* they will become engaged in second notches 54*e*, 56*e*; and when they clear second detents 54*d*, 56*d* they will become engaged in first notches 54*c*, 56*c*.

It should be noted that when second protrusion 28 is withdrawn from second recess 48 it has to be tilted at an angle to clear the various detents. This angular arrangement is facilitated by the offset arrangement between the pairs of detents 54*b*, 56*b*; 54*d*, 56*d*; and 54*f*, 56*f* and the pairs of notches 54*c*, 56*c* and 54*e*, 56*e*. The angular orientation of face 56*a* also ensures that second protrusion 28 is able to rotate through the required angle to disengage it from second recess 48.

Third recess 46 is defined by two faces 58, 60 that are mirror images of each other. First face 58 includes a first section 58*a*, a second section 58*b*, and a third section 58*c*. First section 58*a* is disposed substantially at right angles to lower surface 22*b* and parallel to each of first and second sides 22*c*, 22*d* of second member 22. Second section 58*b* preferably is disposed at an angle of about 60° relative to first section 58*a* although other angles are possible. Third section 58*c* is disposed substantially parallel to lower surface 22*c* and at right angles to first section 58*a*. Second face 60 has a first section 60*a* that corresponds to first section 58*a*; a second section 60*b* that corresponds to second section 58*b*; and a third section 60*c* that corresponds to third section 58*c*. Thus, third sections 58*c*, 60*c* are horizontally aligned with each other and second sections 58*b*, 60*b* flare outwardly away from each other. A divot 62 is defined between third section 58*c* and third section 60*c*. Third recess 46 is generally U-shaped in cross-section when viewed from one or the other ends of second member 22. This configuration enables the walls 64, 66 to flex slightly into third recess 46 when first and second protrusions 26, 28 are engaged in first and third recess 44, 48 and are removed therefrom.

Figure 3:
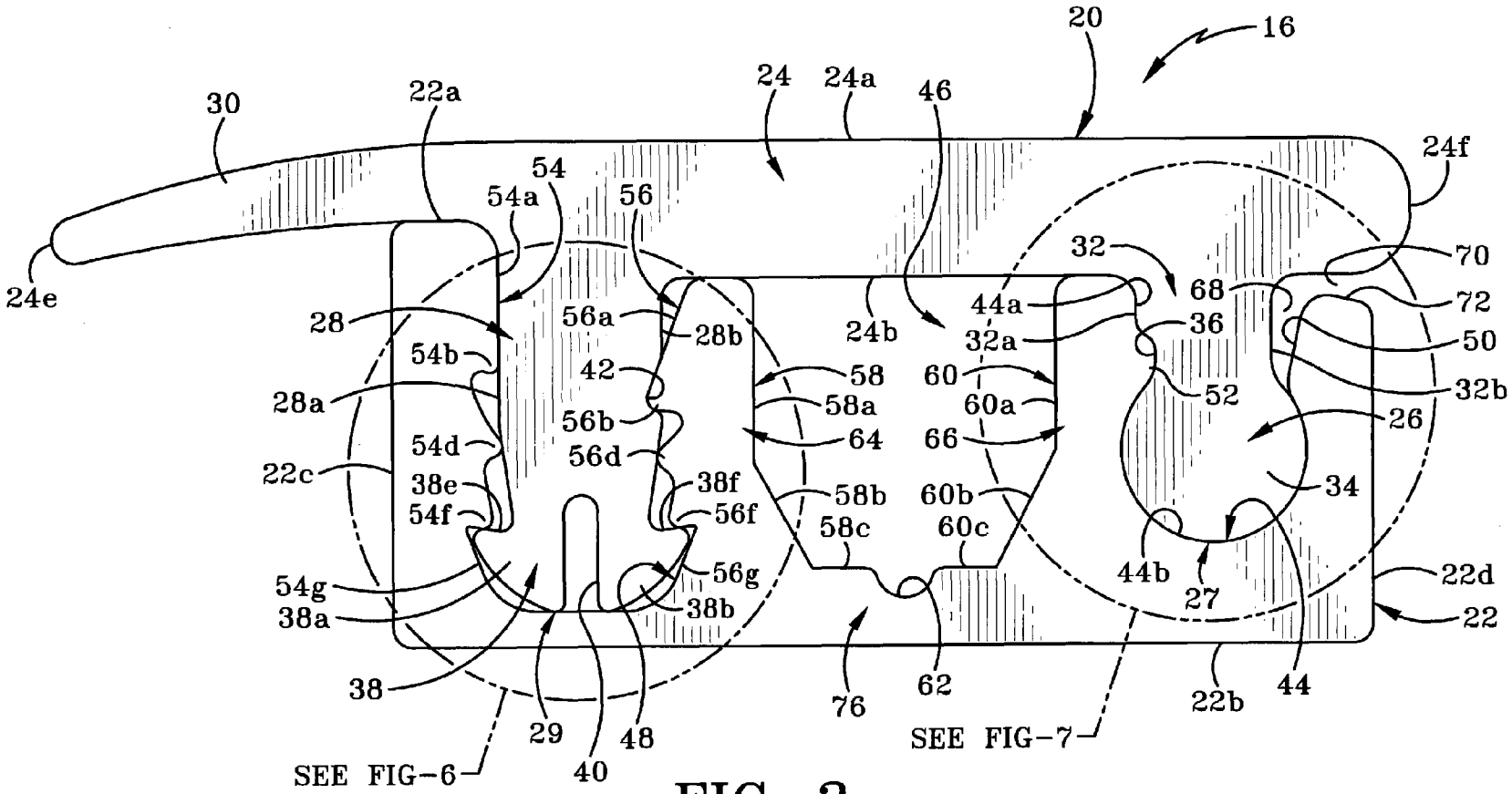
FIG. 3 is a side view of a first embodiment of the divider shown detached from the floor system of FIG. 2, and showing a first member and a second member thereof in an engaged position.

FIG. 3 shows first member 20 engaged with second member 22. As is evident from this figure, first protrusion 26 is received within first recess 44 in such a way that terminal end 34 substantially fully occupies channel 44*b*, and detent 52 on stem 32 is interlockingly engaged with notch 36. It should be noted that a first gap 68 is defined between face 50 and second side surface 32*b* of stem 32. A second gap 70 is defined between bottom surface 24*b* of base 24 and top end 72 of second member 22. Second protrusion 28 is engaged in second recess 48 such that first and second flanges 38*a*, 38*b* are disposed in the lowermost region 48*a* of second recess 48. Shoulders 38*e* and 38*f* are interlockingly engaged with second detents 54*f*, 56*e*.

Flooring system 10 including divider 16 is installed and used in the following manner. First and second flooring surfaces 12, 14 are installed on base surface 18 by any suitable known methods. A gap 72 (FIG. 2) is left between first and second flooring surfaces 12, 14. Preferably gap 72 is substantially complementary in size to the width "W" of second member 22. (Width "W" is measured between first and second sides 22*c*, 22*d*.) Second member 22 is then ready to be position within gap 72. When this is done, the installer must take notice of which of the two flooring surfaces 12, 14 is lower in height relative to base surface 18. Second member 22 is then oriented so that first side 22*c* is disposed adjacent the lower height flooring surface. In FIG. 2, for example, first flooring surface 12 is slightly lower in height relative to second flooring surface 14. First side 22*c* is therefore positioned adjacent first flooring surface 12. Fasteners 74 are inserted into third recess 46, are screwed through a portion of wall 76, and into base surface 18. Fasteners 74 are screwed into base surface 18 at intervals along length "L" of second member 22. It will be understood that any suitable type of fastener may be used for this purpose. A fastener that is configured to be complementary to at least a portion of the shape of third recess 46 is particularly desirable. Still further, third recess 46 preferably is a counterbore hole so that fastener 74 is disposed either flush with or beneath the upper surface of second member 22. It will further be understood that any type of mechanism other than fasteners which is able to releasably secure second member 22 to base surface 18 may be utilized without departing from the scope of the present invention.

First member 20 is then snap-fittingly engaged with second member 22 by positioning first protrusion 26 in the mouth of first recess 44 and second protrusion 28 in the mouth of second recess 48. First member 20 is pushed downwardly in the direction of arrow "A" (FIG. 2) to cause first and second protrusions 26, 28 to move through first and third recesses 44, 48 until the bottom ends 27, 29 thereof reach the bottom ends of the associated recesses. When first member 20 is thus engaged with second member 22, flange 30 extends for a distance along the upper surface 12*a* of first flooring surface 12 and coverers any gap between edge 12*b* of flooring surface 12 and first side 22*c* of second member 22. First side 24*e* of first member 20 rests on upper surface 12*a* of first flooring surface 12 and retains first flooring surface 12 in place and prevents it from being lifted from base surface 18. Additionally, second side 24*f* of first member 20 projects for a short distance beyond first edge 14*a* of second flooring surface 14 and covers any gap between first edge 14*a* and second side 22*d* of second member 22. As shown in FIG. 2, because of the height of second flooring surface 14, second side 24*e* of first member 20 tends to abut first edge 14*a*. First member 20 projects for a small distance above the upper surfaces 12*a*, 14*b* of first and second flooring surfaces 12, 14 and provides a gently sloped and more aesthetically appealing transition between these two surfaces than would be the case if divider 16 was not used. Additionally, if the size of gap 72 between first and second floor surfaces 12, 14 is of an uneven width along its length, divider 16 hides this issue.

If at some later stage the first flooring surface 12, which is a rubber mat, must be removed for cleaning or for replacement, first member 20 may be quickly and easily disengaged to a sufficient degree to enable first flooring surface 12 to be lifted off base surface 18. This disengagement may be partial, such as in FIG. 8 or complete such as in FIGS. 4 and 5. If first member 20 of divider 16 becomes damaged then first member 20 would be completely detached from second member 22 and would be replaced with another first member.

Figure 8:
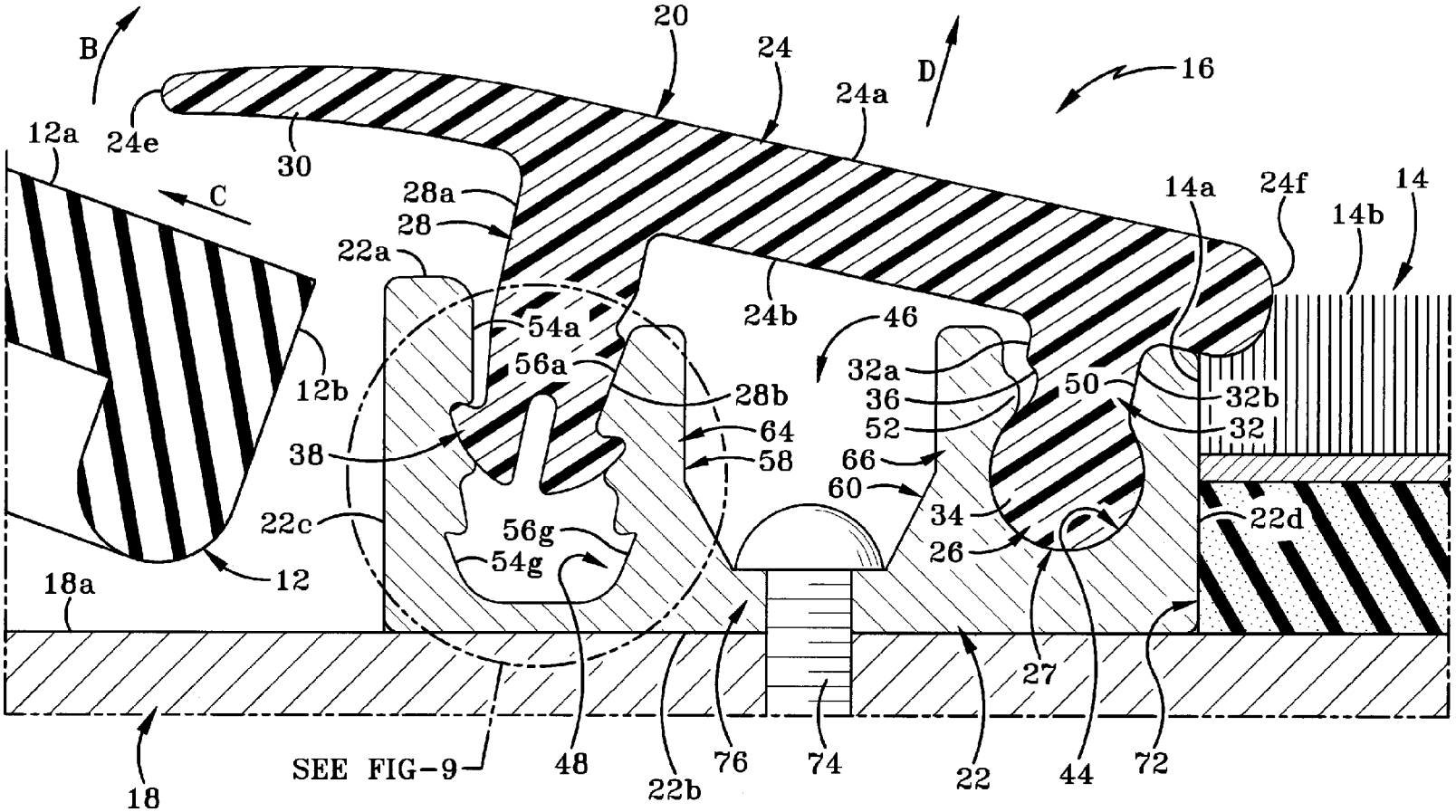
FIG. 8 is a cross-sectional side view of the floor system showing the divider moved to a disengaged position so that a floor mat may be removed from the system.
Figure 9:
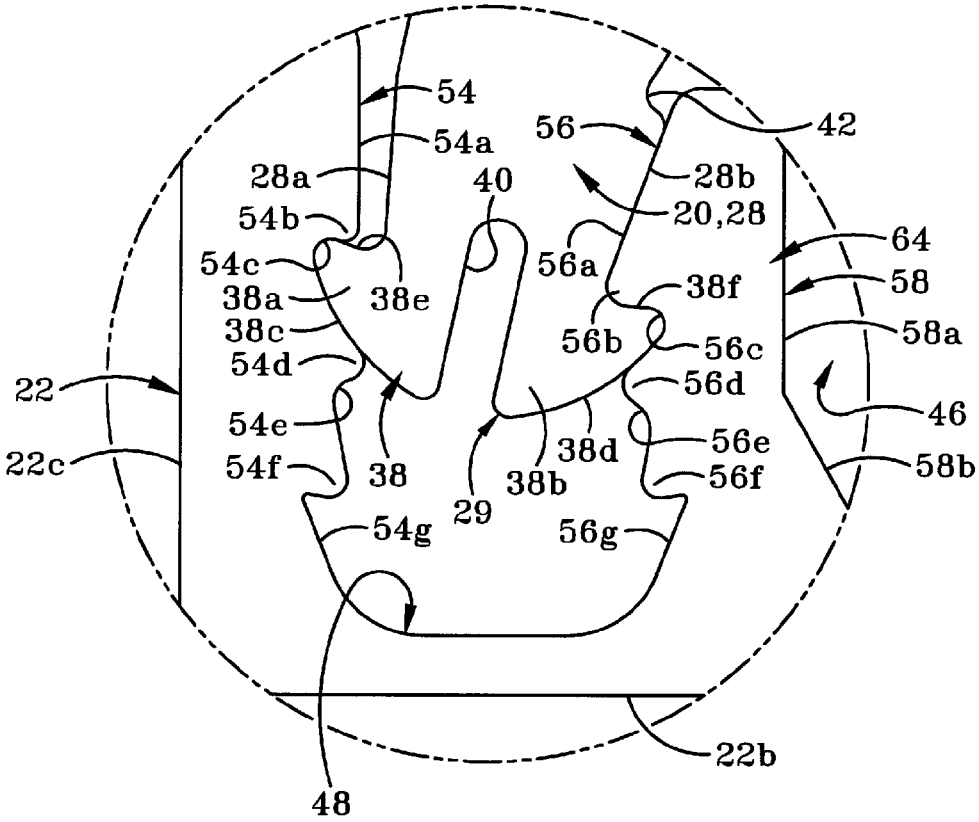
FIG. 9 is an enlarged cross-sectional side view of the highlighted region of FIG. 8.

The partial disengagement of first member 20 from second member 22 is shown in FIG. 8. This figure shows first member 20 rotated from a first position where it is substantially parallel to lower surface 22*b* of second member 22, to a second position where it is disposed at an angle relative thereto. The rotation is accomplished by engaging flange 30 and lifting it upwardly in the direction of arrow "B". This rotational or pivotal motion causes second side surface 32*b* of stem 32 on first protrusion 26 to move into engagement with face 50 and causes second side surface 28*b* of second protrusion 28 to move into engagement with face 56*a*. Rotation in the direction of arrow "B" also causes first and second flanges 38*a*, 38*b* on second protrusion 28 to progressively move from third notches 54*g*, 56*g* to second notches 54*e*, 56*e*, to first notches 54*c*, 56*c* (as shown in FIG. 9). As may be noted from FIG. 8, when first member 20 is rotated in the direction of arrow "B" the detent 52 on wall 66 becomes disengaged from notch 36. First member 20 is then retained at an angle relative to lower surface 22*b* and base surface 18. This angle is sufficient to permit first flooring surface 12 to be lifted from base surface 18 in the direction of arrow "C". A cleaned first flooring surface 12 or a new flooring surface (not shown) may then be positioned in the appropriate location on base surface 18 so that an edge thereof abuts first side 22*c* of second member 22. First member 20 is then snapped back into engagement with second member 22 by pushing it downwardly on a region generally above second protrusion 28. This downwardly directed force causes first member 20 to rotate in the opposite direction of arrow "B" until flange 30 on first member 20 comes to rest on the upper surface 12*a* of the cleaned first flooring surface 12. First flooring surface 12 is then substantially prevented from being disengaged from divider 16. FIG.

8 therefore shows divider 16 in an unlocked position and FIG. 2 shows divider 2 in a locked position.

If it is first member 20 itself which must be replaced, when second protrusion 28 disengages from second recess 48, first protrusion 26 may be easily withdrawn from first recess 44 by simply pulling first member 20 outwardly in a direction indicated by arrow "D" (FIG. 8). A replacement first member (not shown) may then be engaged with second member 22 in the same manner as described above with reference to first member 20. Second member 22 remains secured to base surface 18 at all times during these operations.

Figure 10:
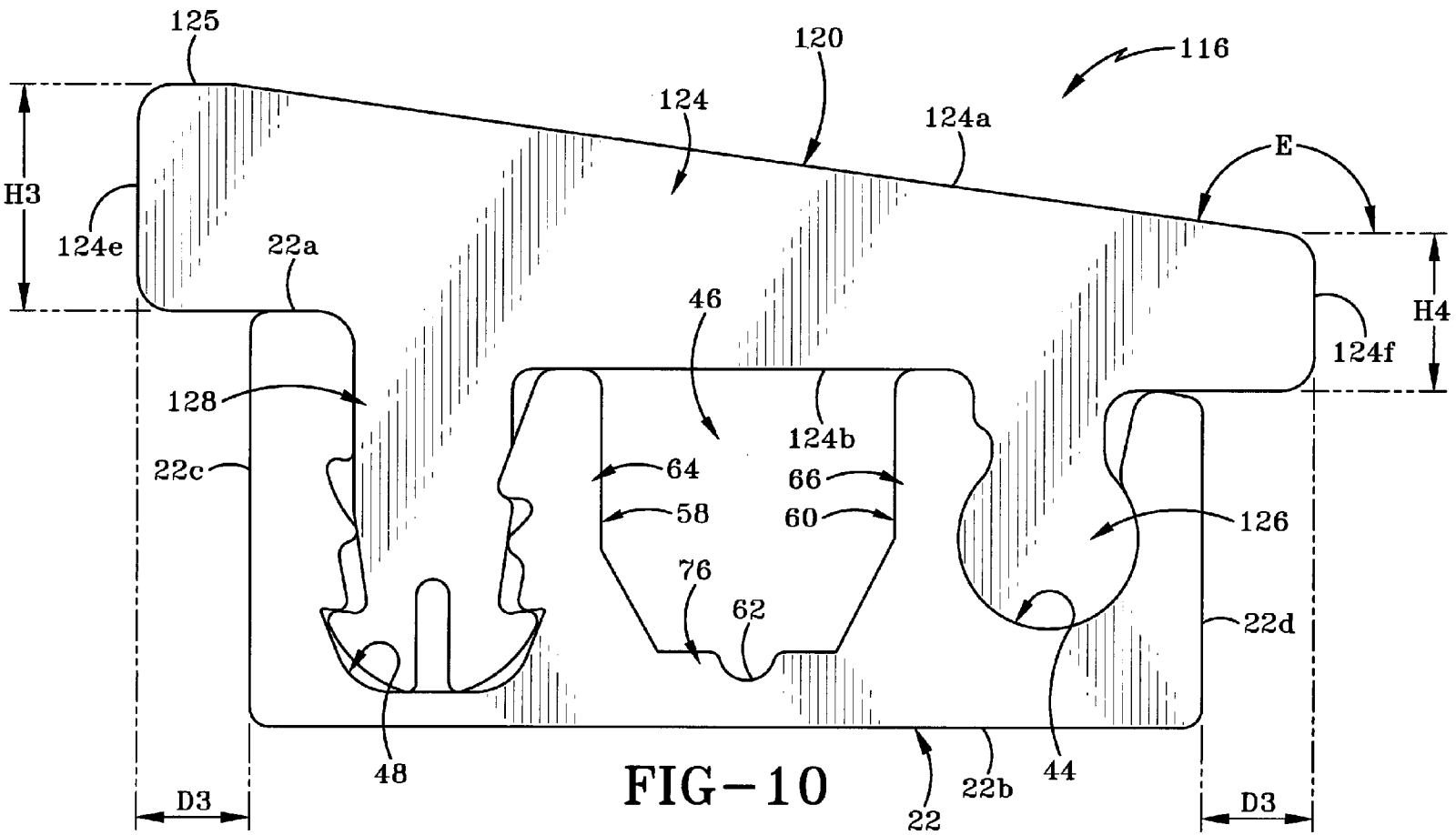
FIG. 10 is a side view of second embodiment of a divider in accordance with the present invention.

FIG. 10 shows a second embodiment of a divider that may be utilized in a floor system in accordance with the present invention. The second embodiment of the divider is indicated by reference number 116. Divider 116 includes a third member 120 and the second member 22. Second member 22 is the identical member to that used in divider 16. Third member 120 is configured to matingly engage second member 22 when first member 20 is detached therefrom. This scenario would occur if there is a need to transition between two flooring surfaces other than first and second flooring surfaces 12, 14. So, for example, second flooring surface 14 is disposed on one side of divider 116 and a flooring surface (not shown) other than first flooring surface 12 is disposed on the opposite side of divider 116. Divider 116 may be used when there is a greater height differential between the two flooring surfaces. In this instance, since second member 22 is permanently secured to base surface 18, first member 20 is disengaged from second member 22 and is replaced by third member 120.

In accordance with a specific feature of the present invention, divider 116 includes a base 124 that differs in cross-sectional shape from that of base 24. Base 124 has an upper surface 124*a*, a lower surface 124*b*, a first and second end (not shown), a first side 124*e*, and a second side 124*f*. A first protrusion 126 and a second protrusion 128 extend outwardly away from lower surface 124*b*. First protrusion 126 is substantially identical to first protrusion 26 and second protrusion 128 is substantially identical to second protrusion 28 in both structure and function. Base 124 is substantially wedge-shaped in cross-section with first side 124*e* being of a height "H3" and second side 124*f* being of a second height "H4". The majority of upper surface 124*a* (except for region 125) is disposed at an angle "E" relative to lower surface 124*b*. Additionally, a portion of lower surface 124*b* extends beyond each of first and second sides 22*c*, 22*d* of second member 22 for about the same distance "D3". Thus, the portions of lower surface 124*b* overhang regions of the base surface (not shown) to which second member 22 is secured. An edge region of each of the flooring surfaces disposed over the regions of the base surface will therefore be partially covered by those overhanging portions of lower surface 124*b*. Thus, divider 116 covers the edges of the two flooring surfaces and makes the transition between them more aesthetically appealing. The engagement of third member 120 with second member 22 and the disengagement therefrom is substantially identical to the engagement and disengagement of first and second members 20, 22.

It will be understood that the cross-sectional configuration of the first member 20 or third member 120 may be altered to suit any pair of flooring surfaces that may be incorporated into a floor system. Thus, the first member may have different cross-sectional shapes from those shown in FIGS. 2 and 10 without departing from the scope of the present invention. Additionally or alternatively, differently configured first and second protrusions 26, 28, 126, 128 may be provided on the first member and complementary configured first and third recesses 44, 48/44, 48 may be defined in the second member 22/22 without department from the scope of the present invention. Furthermore, portions of the first member may overhang sides 22*c*, 22*d*/22*c*, and 22*d* of second member 22/22 to varying degrees and in different ways without departing from the scope of the present invention.

It will further be understood that flooring system 10 may include a divider kit comprised of a plurality of differently configured first members that are provided in combination with one single second member. This kit will enable an installer to select the most appropriate one of the differently configured first members for a particular flooring solution. Thus, in accordance with the present invention the flooring system 10 includes:

- a first flooring surface 12 that is positioned upon a base surface 18;
- a second flooring surface 14 positioned on base surface 18 in end-to-end relationship with first flooring surface 12 and separated therefrom by a gap 72; and
- a divider kit for transitioning gap 72 between first and second flooring surfaces 12, 14; and wherein the kit comprises:
  - a plurality of first members 20, 120, each of first members 20, 120 having a different cross-sectional shape;
  - a second member 22 adapted to be secured to base surface 18; wherein one of the plurality of first members 20, 120 is selected for engagement with second member 22 to suit first and second flooring surfaces 12, 14 to be installed on base surface 18; and wherein the selected one of first members 20, 120 is releasably securable to second member 22 and is rotatable between a first position where it is disposed substantially parallel to a lower surface 22*b* of second member 22, and a second position where it is disposed at an angle relative to lower surface 22*b* of second member 22.

It will further be understood that the first and second members 20, 22/120, 22 may be made of the same material or may be made from different materials. For example, both of the first and second members may be made from plastic or metal, or, one of the first and second members may be made from plastic and the other from metal, without departing from the scope of the present invention. Preferably, second member 22 is manufactured from a metal, such as extruded aluminum, and first member 20/120 is manufactured from extruded vinyl. The second member 22 preferably is made from metal as this material is more durable than other materials.

It will be understood that when divider 16/116 has been installed on base surface 18 it may be a permanent fixture and does not need to be rotatable. Second embodiment of divider, i.e., divider 22 is of this type of configuration. Divider 22 can, however, be rotated by applying an upward force on the region of first member 120 overhanging first side 22*c* of second member.

It will further be understood that while dividers 16/116 have been described as being used for transitioning between a first flooring surface and a second flooring surface, dividers 16/116 may be used in many applications where a transition between adjacent first and second substantially planar surfaces is needed. For example, dividers 16/116 may be used as transitions between two wall coverings between two fabric coverings, without departing from the scope of the invention.

It will further be understood that the protrusions 26, 28 may be formed on the upper surface of the second member 22 and the complementary recesses 44, 48 be defined in the lower surface of the first member 20 without departing from the scope of the invention. In this latter instance the third recess 46 would remain defined in the second member 22 and between the two protrusions as the third recess 46 receives a fastener 74 to secure the second member 22 to base surface 18.

It will be still further understood that while it has been disclosed herein that the first member is rotatable between a first position where it is disposed substantially parallel to a lower surface of the second member, and a second position where it is disposed at an angle relative to the lower surface of the second member, the first member may be rotated through three or more positions relative to the lower surface of the second member. At each additional position, the first member will be disposed at a different angle relative to the lower surface of the second member. These additional positions of the first member could be utilized to accommodate a variety of different thickness first and second surfaces.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A divider for transitioning between a first surface and a second surface disposed in end-to-end relationship upon a base surface;

said divider comprising:

a first member;

a second member adapted to be secured to the base surface between the ends of the first and second surfaces; wherein the first member is releasably securable to the second member;

a recess defined in an upper surface of the second member;

a protrusion extending outwardly from a lower surface of the first member; and wherein the protrusion is engageable in the recess to secure the first and second members together;

a first flange extending outwardly from a free end of the protrusion in a first direction;

a second flange extending outwardly from the free end of the protrusion in a second direction;

a slot defined between the first and second flanges; and wherein the first and second flanges flex inwardly into the slot and toward each other when the protrusion is inserted into the recess or is partially or completely withdrawn from the recess;

a second recess defined in the upper surface of the second member a spaced distance from the recess; and a second protrusion extending outwardly from the lower surface of the first member; and wherein the second protrusion is engageable in the second recess to secure the first and second members together.

2. The divider as defined in claim 1, wherein the first member is rotatable between a first position where it is disposed substantially parallel to a lower surface of the second member, and a second position where it is disposed at an angle relative to the lower surface of the second member.

3. The divider as defined in claim 1, further comprising:

a first notch defined in a wall of the second member which defines the recess; wherein the first flange is received in the first notch; and a second notch defined in the wall which defines the recess; and wherein the second flange is received in the second notch.

4. A divider for transitioning between a first surface and a second surface disposed in end-to-end relationship upon a base surface; said divider comprising:

a first member;

a second member adapted to be secured to the base surface between the ends of the first and second surfaces; wherein the first member is releasably securable to the second member; and wherein the first member is rotatable between a first position where it is disposed substantially parallel to a lower surface of the second member, and a second position where it is disposed at an angle relative to the lower surface of the second member;

a first recess defined in an upper surface of the second member;

a first protrusion extending outwardly from a lower surface of the first member; and wherein the first protrusion is engageable in the first recess to secure the first and second members together;

a second recess defined in the upper surface of the second member a spaced distance from the first recess; and a second protrusion extending outwardly from the lower surface of the first member; and wherein the second protrusion is engageable in the second recess to secure the first and second members together;

a first flange extending outwardly from a free end of the second protrusion in a first direction;

a second flange extending outwardly from the free end of the second protrusion in a second direction;

a first notch defined in a wall of the second member which defines the second recess; wherein the first flange is received in the first notch; and a second notch defined in the wall which defines the second recess; and wherein the second flange is received in the second notch; and a slot defined between the first and second flanges; and wherein the first and second flanges flex inwardly into the slot and toward each other when the second protrusion is inserted into the second recess or is partially or completely withdrawn from the second recess.

5. The divider as defined in claim 4, further comprising a terminal end disposed on the first protrusion, wherein the terminal end is substantially circular in cross-section, and wherein the first recess includes a region complementary to the terminal end; and the first member pivots on the terminal end when moved between the first and second positions.

6. The divider as defined in claim 5, wherein the first member snap-fittingly engages the second member.

7. The divider as defined in claim 4, further comprising:

a notch defined in one of the first protrusion and a wall defining the first recess; and a detent defined in the other of the first protrusion and the wall; and wherein the detent is receivable in the notch to interlockingly secure the first protrusion in the first recess.

8. The divider as defined in claim 7, wherein the detent is engaged in the notch when the first member is in the first position, and the detent is disengaged from the notch when the first member is in the second position.

9. The divider as defined in claim 4, wherein the first member includes a flange that extends for a distance outwardly beyond a side surface of the second member.

10. The divider as defined in claim 4, wherein the first member has an upper surface and a lower surface; and when the first member is in the first position the lower surface of the first member is disposed substantially parallel to the lower surface of the second member; and the upper surface of the first member is disposed at an angle relative to the lower surface of the second member.

11. The divider as defined in claim 4, further comprising a third recess disposed between the first and second recesses; and a fastener; and wherein the fastener is disposed within the third recess and is adapted to secure the second member to the base surface.

12. A flooring system comprising:

a first flooring surface that is adapted to be positioned upon a base surface;

a second flooring surface adapted to be positioned on the base surface in end-to-end relationship with the first flooring surface and to be separated therefrom by a gap; and a divider positionable in the gap to provide a transition from the first flooring surface to the second flooring surface; and wherein the divider comprises:

a first member;

a second member adapted to be secured to the base surface; wherein the first member is releasably securable to the second member;

a recess defined in an upper surface of the second member;

a protrusion extending outwardly from a lower surface of the first member; and wherein the protrusion is engageable in the recess to secure the first and second members together;

a first flange extending outwardly from a free end of the protrusion in a first direction;

a second flange extending outwardly from the free end of the protrusion in a second direction;

a slot defined between the first and second flanges; and wherein the first and second flanges flex inwardly into the slot and toward each other when the protrusion is inserted into the recess or is partially or completely withdrawn from the recess;

another recess defined in the upper surface of the second member a spaced distance from the recess; and another protrusion extending outwardly from the lower surface of the first member; and wherein the other protrusion is received in the other recess; and the other protrusion includes a terminal end that is substantially circular in cross-section and is received in a complementary region of the other recess.

13. The flooring system as defined in claim 12, wherein the first member is rotatable between a first position where it is disposed substantially parallel to a lower surface of the second member, and a second position where it is disposed at an angle relative to the lower surface of the second member.

14. The flooring system as defined in claim 13, further comprising a terminal end disposed on the other protrusion, wherein the terminal end is substantially circular in cross-section, and wherein the other recess includes a region complementary to the terminal end; and the first member pivots on the terminal end when moved between the first and second positions.

15. The flooring system as defined in claim 12, further comprising a third member that is selectively engageable with the second member when the first member is detached from the second member; and wherein the first member and third member have different cross-sectional shapes and are configured to be used to transition between two different sets of first and second flooring surfaces.

16. A flooring system comprising:

a first flooring surface that is adapted to be positioned upon a base surface;

a second flooring surface adapted to be positioned on the base surface in end-to-end relationship with the first flooring surface and to be separated therefrom by a gap; and a divider kit for transitioning the gap between the first and second flooring surfaces; and wherein the kit comprises:

a plurality of first members, each of the first members having a different cross-sectional shape;

a second member adapted to be secured to the base surface; wherein one of the plurality of first members is selected for engagement with the second member to suit the first and second flooring surfaces to be installed on the base surface; and wherein the selected one of the first members is releasably securable to the second member;

a recess defined in an upper surface of the second member;

a protrusion extending outwardly from a lower surface of the first member; and wherein the protrusion is engageable in the recess to secure the first and second members together;

a first flange extending outwardly from a free end of the protrusion in a first direction;

a second flange extending outwardly from the free end of the protrusion in a second direction;

a slot defined between the first and second flanges; and wherein the first and second flanges flex inwardly into the slot and toward each other when the protrusion is inserted into the recess or is partially or completely withdrawn from the recess.

17. The divider as defined in claim 1, further comprising:

another recess defined in the upper surface of the second member a spaced distance from the recess;

another protrusion extending outwardly from the lower surface of the first member; and wherein the other protrusion is received in the other recess; and the other protrusion includes a terminal end that is substantially circular in cross-section and is received in a complementary region of the other recess.

18. The divider as defined in claim 1, wherein the first member snap-fittingly engages the second member.

* * * * *